US009838774B2

(12) United States Patent
Lee et al.

(10) Patent No.: US 9,838,774 B2
(45) Date of Patent: Dec. 5, 2017

(54) HEADSET APPARATUS

(71) Applicant: Merry Electronics(Shenzhen) Co., Ltd., Guangdong (CN)

(72) Inventors: Chun-Yuan Lee, New Taipei (TW); Tsu-Jung Wang, New Taipei (TW); Hung-Yuan Li, New Taipei (TW); Chien-Min Yao, New Taipei (TW)

(73) Assignee: Merry Electronics(Shenzhen) Co., Ltd., Guangdong (CN)

( * ) Notice: Subject to any disclaimer, the term of this patent is extended or adjusted under 35 U.S.C. 154(b) by 0 days.

(21) Appl. No.: 15/415,889

(22) Filed: Jan. 26, 2017

(65) Prior Publication Data

US 2017/0230743 A1 Aug. 10, 2017

Related U.S. Application Data

(60) Provisional application No. 62/290,966, filed on Feb. 4, 2016.

(51) Int. Cl.
*H04R 1/10* (2006.01)
*H04R 29/00* (2006.01)

(52) U.S. Cl.
CPC ..... *H04R 1/1041* (2013.01); *H04R 29/001* (2013.01); *H04R 1/1008* (2013.01); *H04R 1/1016* (2013.01); *H04R 2420/07* (2013.01); *H04R 2460/03* (2013.01)

(58) Field of Classification Search
CPC ..... H04R 1/1041; H04R 5/033
See application file for complete search history.

(56) References Cited

U.S. PATENT DOCUMENTS 8,447,556 B2 * 5/2013 Friedrich ..... G01R 33/0023 702/116
2006/0233413 A1 10/2006 Nam
2011/0117840 A1 * 5/2011 Li ..... H04M 1/0258 455/41.2
2013/0038458 A1 2/2013 Toivola et al.
2014/0064500 A1 3/2014 Lee
2016/0048205 A1 * 2/2016 Baier ..... G06F 3/014 345/156

FOREIGN PATENT DOCUMENTS

CN 203057476 7/2013
TW 515624 12/2002
TW I348601 9/2011

* cited by examiner

*Primary Examiner* — Mohammad Islam
(74) *Attorney, Agent, or Firm* — JCIPRNET

(57) ABSTRACT

A headset apparatus including an audio transmitter, a control circuit, a magnetic field generator and a magnetic field sensor is provided. The control circuit is configured to generate a test signal. The magnetic field generator is coupled to the control circuit to receive the test signal and generate a magnetic field accordingly. The magnetic field sensor is coupled to the control circuit and configured to sense the magnetic field and generate a sensing signal accordingly. When the control circuit detects that the magnetic field is changed based on the sensing signal, the control circuit generates a control signal to enable the audio transmitter.

9 Claims, 3 Drawing Sheets

HEADSET APPARATUS

CROSS-REFERENCE TO RELATED APPLICATION

This application claims the priority benefit of U.S. provisional application Ser. No. 62/290,966, filed on Feb. 4, 2016. The entirety of the above-mentioned patent application is hereby incorporated by reference herein and made a part of this specification.

BACKGROUND OF THE INVENTION

1. Field of the Invention

The invention relates to a headset apparatus and more particularly relates to a headset apparatus which is turned on or off based on an inductive sensing technique.

2. Description of Related Art

With the advancement of technology, the development of electronic devices is getting quickly. Specifically, headset is a medium for transmitting sound between electronic devices and human ears. Through the headset, sound can be transmitted to human ears.

To meet the requirement in use, a power switch or a power button is set in many wireless headset. User has to press the power button or slide the power switch to turn the headset on for using the headset. By contrast, user also has to press the power button or slide the power switch to turn the headset off for stopping using the headset. However, pressing the power button or sliding the power switch may often cause inconvenient to users.

SUMMARY OF THE INVENTION

The invention provides a headset apparatus, which detects whether a user wear the headset apparatus or not and automatically turns the headset apparatus on or off accordingly to increase convenience when using the headset apparatus.

The headset apparatus of the invention includes an audio transmitter, a control circuit, a magnetic field generator and a magnetic field sensor. The control circuit is configured to generate a test signal. The magnetic field generator is coupled to the control circuit to receive the test signal and generate a magnetic field accordingly. The magnetic field sensor is coupled to the control circuit and configured to sense the magnetic field and generate a sensing signal accordingly. When the control circuit detects that the magnetic field is changed based on the sensing signal, the control circuit generates a control signal to enable the audio transmitter.

In an embodiment of the invention, after a headset plug of the headset apparatus is plugged into a headset jack of an electronic device or the headset apparatus is detached from an accommodating case, the control circuit generates the test signal and detects whether the magnetic field is changed every setting time interval.

In an embodiment of the invention, after a headset plug of the headset apparatus is removed from a headset jack of an electronic device or the headset apparatus is placed in an accommodating case, the control circuit stops generating the test signal and disables the audio transmitter.

In an embodiment of the invention, the control circuit enables the audio transmitter when the control circuit detects that an amount of variation of the magnetic field is greater than a threshold based on the sensing signal.

In an embodiment of the invention, the headset apparatus is an in-ear type headset apparatus. The headset apparatus further includes an earplug, a housing and a circuit board. The housing has an accommodating portion and an acoustic tube. The acoustic tube is connected to the earplug to form an acoustic channel. The circuit board is disposed in the accommodating portion, and the control circuit is disposed on the circuit board and electrically connected to the audio transmitter. The audio transmitter is disposed in the accommodating portion, and an acoustic plane of the audio transmitter is facing toward to the acoustic channel. The magnetic field generator and the magnetic field sensor are electrically connected to the control circuit through a conductive element. One of the magnetic field generator and the magnetic field sensor is disposed on an outer surface of the acoustic tube or an inner surface of the earplug, and another of the magnetic field generator and the magnetic field sensor is disposed on an inner surface of the acoustic tube.

In an embodiment of the invention, the headset apparatus is in-ear type headset apparatus. The headset apparatus further includes an earplug, a housing and a circuit board. The housing has an accommodating portion and an acoustic tube. The acoustic tube is connected to the earplug to form an acoustic channel. The circuit board is disposed in the accommodating portion, and the control circuit is disposed on the circuit board and electrically connected to the audio transmitter. The audio transmitter is disposed in the accommodating portion. An acoustic plane of the audio transmitter is facing toward to the acoustic channel, and a space is between the acoustic plane and the acoustic tube. The magnetic field generator and the magnetic field sensor are electrically connected to the control circuit through a conductive element. The magnetic field generator and the magnetic field sensor are disposed in the space.

In an embodiment of the invention, the headset apparatus is an in-ear type headset apparatus. The headset apparatus further includes an earplug, a housing and a circuit board. The housing has an accommodating portion and an acoustic tube. The acoustic tube is connected to the earplug to form an acoustic channel. The circuit board is disposed in the accommodating portion, and the control circuit is disposed on the circuit board and electrically connected to the audio transmitter. The audio transmitter is disposed in the accommodating portion. The audio transmitter has an acoustic plane and a base. The acoustic plane is facing toward the acoustic channel, and the base is opposed to the acoustic channel. The magnetic field generator and the magnetic field sensor are electrically connected to the control circuit through a conductive element. One of the magnetic field generator and the magnetic field sensor is disposed in a space between the acoustic plane and the acoustic tube. Another of the magnetic field generator and magnetic field sensor is disposed on the base.

In an embodiment of the invention, the headset apparatus is an on-ear type headset apparatus. The headset apparatus further includes a head-wearing frame and an earmuffs component. The earmuffs component is disposed at both ends of the head-wearing frame. The earmuffs component includes a housing and a cushioning earpad. The audio transmitter is disposed within the housing. The magnetic field generator and the magnetic field sensor may be disposed within the head-wearing frame or within the housing or within the cushioning earpad.

In an embodiment of the invention, each of the magnetic field generator and the magnetic field sensor includes a conductive wire or an electrode.

Based on the above, the headset apparatus according to the embodiment of this invention detects whether a user wear the headset apparatus or not based on an inductive sensing technique and automatically turns the headset apparatus on or off accordingly. Therefore, the convenience of using the headset apparatus is increased.

To make the above features and advantages of the invention more comprehensible, several embodiments accompanied with drawings are described in detail as follows.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
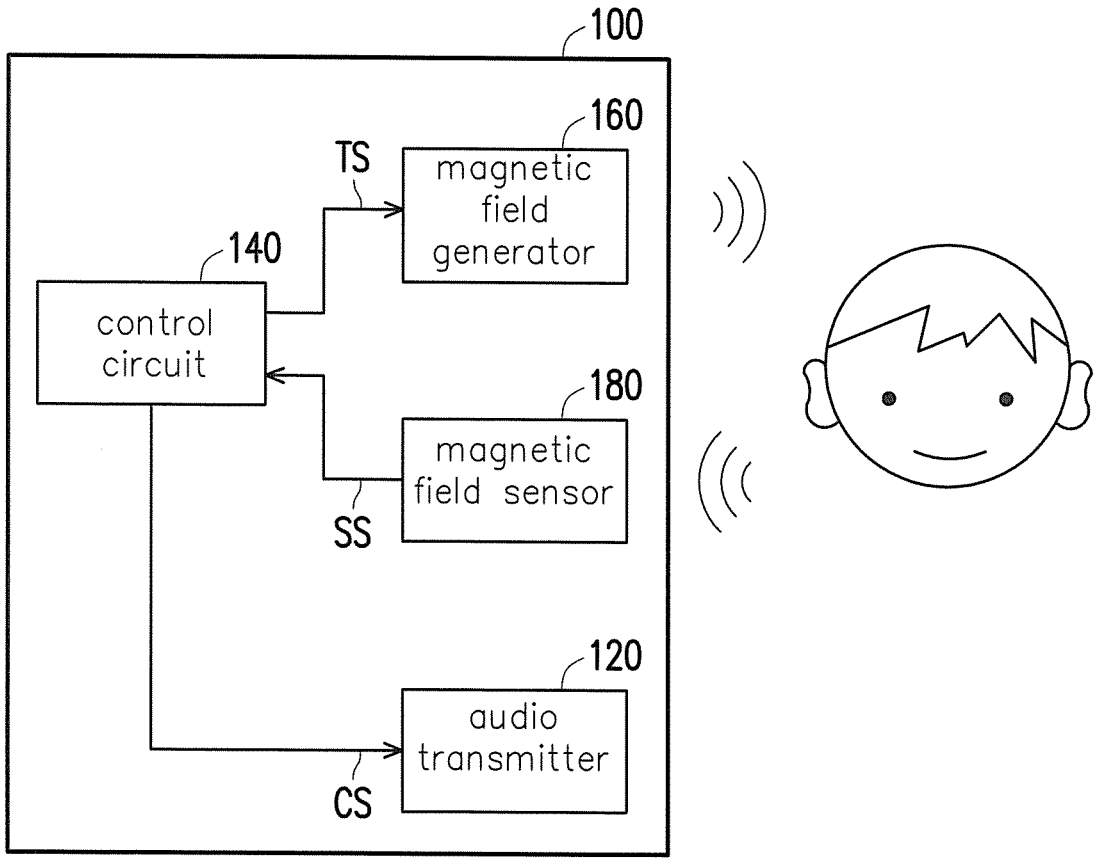
FIG. 1 is a block diagram illustrating a headset apparatus according to an embodiment of the invention.

In order to make the invention more comprehensible, embodiments are described below as the examples to show the invention. Moreover, elements/components with the same reference numerals are used to represent the same or similar parts in the drawings and embodiments.

FIG. 1 is a block diagram illustrating a headset apparatus according to an embodiment of the invention. Hereinafter referring to FIG. 1. The headset apparatus 100, for example, is a wireless in-ear type headset apparatus or a wireless on-ear type headset apparatus, the invention is not limited thereto. The headset apparatus 100 includes an audio transmitter 120, a control circuit 140, a magnetic field generator 160 and a magnetic field sensor 180. The control circuit 140 is configured to generate a test signal TS. The magnetic field generator 160 is coupled to the control circuit 140 to receive the test signal TS and generate a magnetic field accordingly. The magnetic field sensor 180 is coupled to the control circuit 140. The magnetic field sensor 180 is configured to sense the magnetic field and generate a sensing signal SS to the control circuit 140 accordingly. When the control circuit 140 detects that the magnetic field is changed based on the sensing signal SS, the control circuit 140 generates a control signal CS to enable the audio transmitter 120.

To be more specified, the magnetic field generator 160 generates the magnetic field in response to the test signal TS. The magnetic field sensor 180 senses the magnetic field and generates the sensing signal SS accordingly. When user wears the headset apparatus 100, for instance, by putting the in-ear type headset apparatus into user's ear, or covering the ear by wearing the on-ear type headset apparatus, the user's ears may change the magnetic field generated by the magnetic field generator 160. Thus, the control circuit 140 may detect that the magnetic field is changed through the sensing signal SS of the magnetic field sensor 180. Therefore, the control circuit 140 determines that the headset apparatus 100 is worn by the user, and the control circuit 140 generates the control signal CS to enable the audio transmitter 120 for turning the headset apparatus 100 on automatically.

In an embodiment of the invention, when the control circuit 140 detects an amount of variation of the magnetic field being greater than a threshold based on the sensing signal SS, the control circuit 140 enables the audio transmitter 120 to turn the headset apparatus 100 on automatically.

Similarly, when user takes off the headset apparatus 100, for instance, by removing the in-ear type headset apparatus from user's ears or taking off the on-ear type headset apparatus from user's ears, the magnetic field generated by magnetic field generator 160 is no longer affected by the user's body, thus, an intensity of the magnetic field is recovered to an original intensity. Therefore, the control circuit 140 detects that the intensity of the magnetic field is recovered based on the sensing signal SS of the magnetic field sensor 180. Accordingly, the control circuit 140 determines that the headset apparatus 100 has been taken off by user, such that the control circuit 140 generates a control signal CS to disable the audio transmitter 120 for turning the headset apparatus 100 off automatically.

In addition, to prevent power consumption of the headset apparatus 100 caused by the control circuit 140 for continuously detecting whether the headset apparatus 100 is worn by user, in an embodiment of the invention, after a headset plug of the headset apparatus 100 is plugged into a headset jack of an electronic device, the control circuit 140 generates the test signal TS and detects whether the magnetic field is changed every setting time interval. Or, after the headset apparatus 100 is detached from an accommodating case, the control circuit 140 generates the test signal TS and detects whether the magnetic field is changed every setting time interval. The accommodating case described above is configured to store and charge the headset apparatus 100, therefore, the control circuit 140 may determine that the headset apparatus 100 is detached from the accommodating case by detecting whether the headset apparatus 100 is charging or not. In an embodiment of the invention, a power of the test signal TS provided by the control circuit 140 every setting time interval could be constant to facilitate the control circuit to determine whether the magnetic field is changed, but the invention is not limited thereto.

In another embodiment of the invention, after a headset plug of the headset apparatus 100 is removed from a headset jack of an electronic device, the control circuit 140 stops generating the test signal TS and disables the audio transmitter 120. Or, after the headset apparatus is placed to the accommodating case, the control circuit 140 stops generating the test signal TS and disables the audio transmitter 120.

In one embodiment of the invention, the audio transmitter 120 is speaker, for example. In one embodiment of the invention, each of the magnetic field generator 160 and the magnetic field sensor 180 may include a conductive wire or electrode, but the invention is not limited thereto, the magnetic field generator 160 and the magnetic field sensor 180 could be implemented according to actual applications or design requirements. In an embodiment of the invention, the control circuit 140 may be implemented by hardware, firmware or executable programming codes stored in memory and loaded by center processor unit (CPU) or digital signal processor (DSP). If the control circuit 140 is implemented by hardware, the control circuit 140 may be achieved by a plurality of signal chips or by an integrated circuit chip, but the invention is not limited thereto. The hardware mentioned above may be application specific integrated circuit (ASIC), field programmable gate array (FPGA) or programmable logic device (PLD) such as complex programmable logic device (CPLD), but the invention is not limited thereto.

Figure 2:
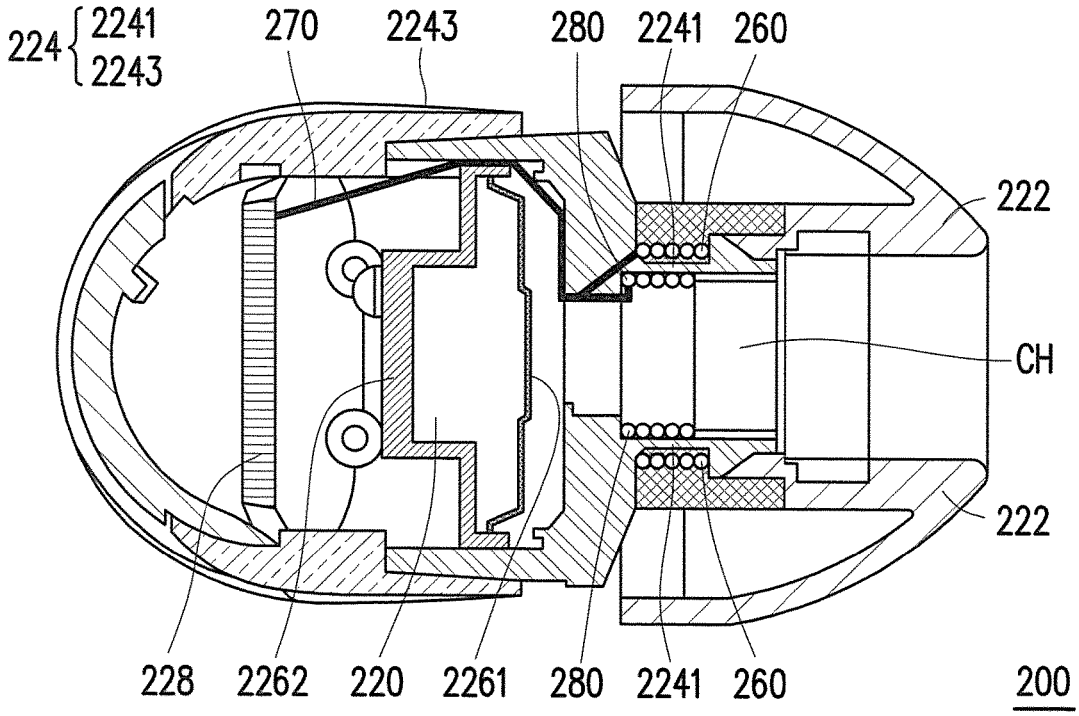
FIG. 2 is a schematic cross-sectional view illustrating a headset apparatus structure of FIG. 1 according to an embodiment of the invention.

FIG. 2 is a schematic cross-sectional view illustrating a headset apparatus structure of FIG. 1 according to an embodiment of the invention. Hereinafter referring to FIG. 2. The headset apparatus 200 of FIG. 2 is a wireless in-ear type headset apparatus. The headset apparatus 200 includes an earplug 222, a housing 224, a circuit board 228, an audio transmitter 220, a control circuit (not shown), a magnetic field generator 260 and a magnetic field sensor 280. The operations of audio transmitter 220, control circuit, magnetic field generator 260 and magnetic field sensor 280 in FIG. 2 are respectively similar to the operations of the audio transmitter 120, the control circuit 140, the magnetic field generator 160 and the magnetic field sensor 180 in FIG. 1. No further description is provided herein, since reference can be directed to the description of FIG. 1. The following provides an illustration of the deposition of the magnetic field generator 260 and the magnetic field sensor 280.

As illustrated in FIG. 2, the housing 224 has an accommodating portion 2243 and an acoustic tube 2241. An accommodating space is between the accommodating portion 2243 and the acoustic tube 2241. The acoustic tube 2241 is connected to the earplug 222 to form an acoustic channel CH. The circuit board 228 is disposed in the accommodating portion 2243. The control circuit (such as the control circuit 140 in FIG. 1) is disposed on the circuit board 228 and electrically connected to the audio transmitter 220. Also, the audio transmitter 220 is disposed in the accommodating portion 2243. An acoustic plane 2261 of the audio transmitter 220 is facing toward to the acoustic channel CH.

The magnetic field generator 260 and the magnetic field sensor 280 are electrically connected to the control circuit (such as the control circuit 140 in FIG. 1) through a conductive element. Each of the magnetic field generator 260 and the magnetic field sensor 280 can be implemented by a spiral tubular coil or a tubular electrode. The magnetic field generator 260 is disposed on or covers an outer surface of the acoustic tube 2241 (or an inner surface of the earplug 222), and the magnetic field sensor 280 is disposed on or covers an inner surface of the acoustic tube 2241, the invention is not limited thereto. In another embodiment of the invention, the deposition of the magnetic field generator 260 and the magnetic field sensor 280 in FIG. 2 can be mutually swapped. That is, the magnetic field sensor 280 can be disposed on or cover the outer surface of the acoustic tube 2241 (or the inner surface of the earplug 222), and the magnetic field generator 260 can be disposed on or cover the inner surface of the acoustic tube 2241. The deposition of the magnetic field generator 260 and the magnetic field sensor 280 could be determined according to actual applications or design requirements.

Figure 3:
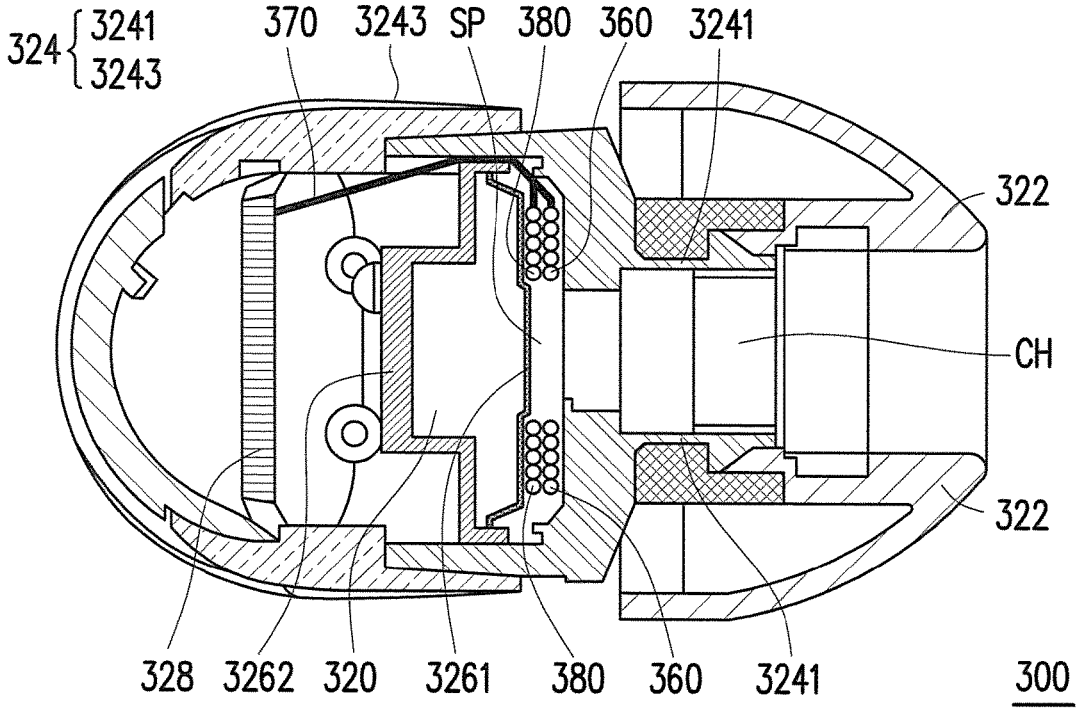
FIG. 3 is a schematic cross-sectional view illustrating a headset apparatus structure of FIG. 1 according to another embodiment of the invention.

FIG. 3 is a schematic cross-sectional view illustrating a headset apparatus structure of FIG. 1 according to another embodiment of the invention. Hereinafter referring to FIG. 3. The headset apparatus 300 of FIG. 3 is a wireless in-ear type headset apparatus. The headset apparatus 300 includes an earplug 322, a housing 324 (an accommodating portion 3243 and an acoustic tube 3241), a circuit board 328, an audio transmitter 320 (an acoustic plane 3261 and a base 3262), a control circuit (not shown), a conductive element 370, a magnetic field generator 360 and a magnetic field sensor 380. The operations of the audio transmitter 320, the control circuit, the magnetic field generator 360 and the magnetic field sensor 380 in FIG. 3 are respectively similar to the operations of the audio transmitter 120, the control circuit 140, the magnetic field generator 160 and the magnetic field sensor 180 in FIG. 1. No further description is provided herein, since reference can be directed to the description of FIG. 1. In addition, the deposition of the earplug 322, the housing 324 (the accommodating portion 3243 and the acoustic tube 3241), the circuit board 328, the audio transmitter 320 (the acoustic plane 3261 and the base 3262) and the conductive element 370 in FIG. 3 are respectively similar to the deposition of the earplug 222, the housing 224 (the accommodating portion 2243 and the acoustic tube 2241), the circuit board 228, the audio transmitter 220 (the acoustic plane 2261 and the base 2262) and the conductive element 270 in FIG. 2. No further description is provided herein, since reference can be directed to the description of FIG. 2. The following provides an illustration of the deposition of the magnetic field generator 360 and the magnetic field sensor 380.

In an embodiment of the invention, a space SP is between the acoustic plane 3261 and the acoustic tube 3241 as shown in FIG. 3. The magnetic field generator 360 is disposed in the space SP near the acoustic tube 3241, and the magnetic field sensor 380 is disposed in the space SP near the acoustic plane 3261, but the invention is not limited thereto. In another embodiment of the invention, the deposition of the magnetic field generator 360 and the magnetic field sensor 380 in FIG. 3 can be mutually swapped. That is, the magnetic field generator 360 may be disposed in the space SP near the acoustic plane 3261, and the magnetic field sensor 380 may be disposed in the space SP near the acoustic tube 3241. The deposition of the magnetic field generator 360 and the magnetic field sensor 380 could be determined according to actual applications or design requirements.

Figure 4:
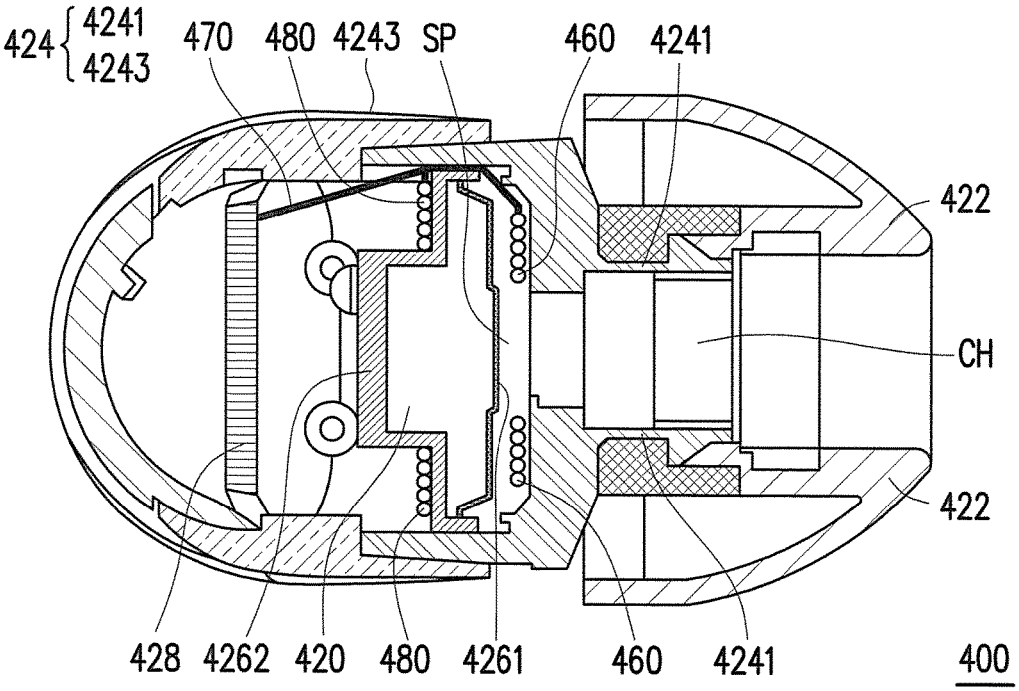
FIG. 4 is a schematic cross-sectional view illustrating a headset apparatus structure of FIG. 1 according to another embodiment of the invention.

FIG. 4 is a schematic cross-sectional view illustrating a headset apparatus structure of FIG. 1 according to another embodiment of the invention. Hereinafter referring to FIG. 4. The headset apparatus 400 of FIG. 4 is a wireless in-ear type headset apparatus. The deposition of the earplug 422, the housing 424 (the accommodating portion 4243 and the acoustic tube 4241), the circuit board 428, the audio transmitter 420 (the acoustic plane 4261 and the base 4262) and the conductive element 470 in FIG. 4 are respectively similar to the deposition of the earplug 222, the housing 224 (the accommodating portion 2243 and the acoustic tube 2241), the circuit board 228, the audio transmitter 220 (the acoustic plane 2261 and the base 2262) and the conductive element 270 in FIG. 2. No further description is provided herein, since reference can be directed to the description of FIG. 2. The difference between the embodiment illustrated in FIG. 4 and other embodiment illustrated above is: the magnetic field generator 460 in FIG. 4 is disposed in a space SP which is between the acoustic plane 4261 and the acoustic tube 4241, and the magnetic field sensor 480 is disposed on the base 4262 of the audio transmitter 420, but the invention is not limited thereto. In another embodiment of the invention, the deposition of the magnetic field generator 460 and the magnetic field sensor 480 in FIG. 4 may be mutually swapped. That is, the magnetic field sensor 480 is disposed in the space SP which is between the acoustic plane 4261 and the acoustic tube 4241, and the magnetic field generator 460 is disposed on the base 4262 of the audio transmitter 420. The deposition of the magnetic field generator 460 and the magnetic field sensor 480 could be determined according to actual applications or design requirements.

Figure 5:
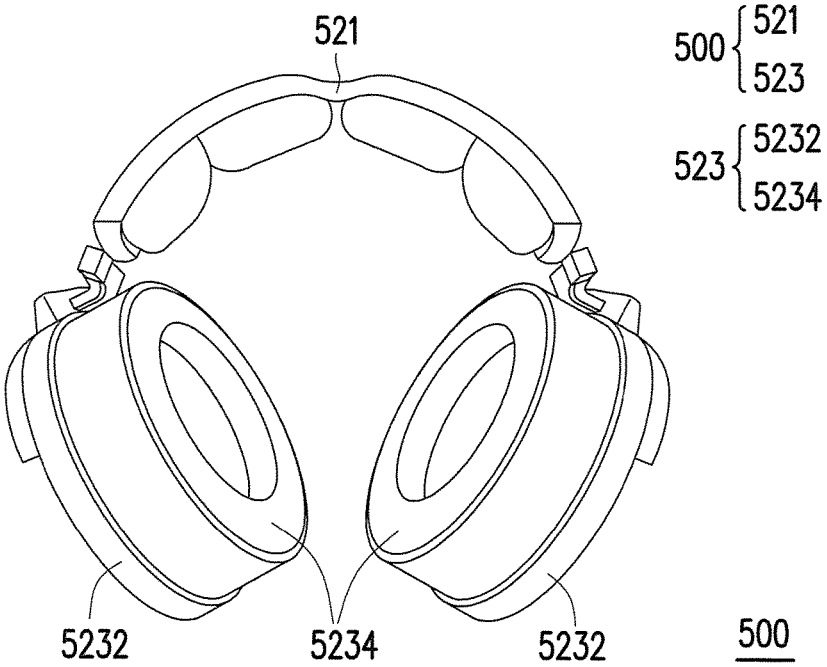
FIG. 5 is a schematic exterior view illustrating a headset apparatus structure of FIG. 1 according to another embodiment of the invention.

FIG. 5 is a schematic exterior view illustrating a headset apparatus structure of FIG. 1 according to another embodiment of the invention. Hereinafter referring to FIG. 1 and FIG. 5 together. The headset apparatus 500 of FIG. 5 is a wireless on-ear type headset apparatus. The headset apparatus 500 includes a head-wearing frame 521, an earmuffs component 523, an audio transmitter (not shown, please referring to the audio transmitter 120 in FIG. 1), a control circuit (not shown, please referring to the control circuit 140 in FIG. 1), a magnetic field generator (not shown, please referring to the magnetic field generator 160 in FIG. 1) and a magnetic field sensor (not shown, please referring to the magnetic field sensor 180). The earmuffs component 523 is disposed at both ends of the head-wearing frame 521. The earmuffs component 523 includes a housing 5232 and a cushioning earpad 5234. For enhancing the comfort of the user when using the headphone device 500, the cushioning earpad 5234 is disposed on the housing 5232 to be a cushion between user's ears and the housing 5232. In addition, the audio transmitter 120 in FIG. 1 is disposed within the housing 5232, and the magnetic field generator 160 and the magnetic field sensor 180 of FIG. 1 may be disposed within the head-wearing frame 521 or within the housing 5232 or within the cushioning earpad 5234, but the invention is not limited thereto.

In summary, the headset apparatus according to the embodiment of this invention detects whether a user wear the headset apparatus or not based on an inductive sensing technique and automatically turns the headset apparatus on or off accordingly. Therefore, the convenience of using the headset apparatus is enhanced.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A headset apparatus, comprising:

an audio transmitter;

a control circuit, configured to generate a test signal;

a magnetic field generator, coupled to the control circuit to receive the test signal and generate a magnetic field accordingly; and a magnetic field sensor, coupled to the control circuit, and configured to sense the magnetic field and generate a sensing signal accordingly, wherein the control circuit generates a control signal to enable the audio transmitter when the control circuit detects that the magnetic field is changed based on the sensing signal.

2. The headset apparatus according to claim 1, wherein after a headset plug of the headset apparatus is plugged into a headset jack of an electronic device or the headset apparatus is detached from an accommodating case, the control circuit generates the test signal and detects whether the magnetic field is changed every setting time interval.

3. The headset apparatus according to claim 1, wherein after a headset plug of the headset apparatus is removed from a headset jack of an electronic device or the headset apparatus is placed in an accommodating case, the control circuit stops generating the test signal and disables the audio transmitter.

4. The headset apparatus according to claim 1, wherein the control circuit enables the audio transmitter when the control circuit detects an amount of variation of the magnetic field being greater than a threshold based on the sensing signal.

5. The headset apparatus according to claim 1, wherein the headset apparatus is an in-ear type headset apparatus, the headset apparatus further comprises:

an earplug;

a housing, having an accommodating portion and an acoustic tube, the acoustic tube is connected to the earplug to form an acoustic channel; and a circuit board, disposed in the accommodating portion, wherein the control circuit is disposed on the circuit board and electrically connected to the audio transmitter, wherein the audio transmitter is disposed in the accommodating portion, and an acoustic plane of the audio transmitter is facing toward to the acoustic channel, wherein the magnetic field generator and the magnetic field sensor are electrically connected to the control circuit through a conductive element, one of the magnetic field generator and the magnetic field sensor is disposed on an outer surface of the acoustic tube or an inner surface of the earplug, and another of the magnetic field generator and the magnetic field sensor is disposed on an inner surface of the acoustic tube.

6. The headset apparatus according to claim 1, wherein the headset apparatus is an in-ear type headset apparatus, the headset apparatus further comprises:

an earplug;

a housing, having an accommodating portion and an acoustic tube, the acoustic tube is connected to the earplug to form an acoustic channel; and a circuit board, disposed to the accommodating portion, wherein the control circuit is disposed on the circuit board and electrically connected to the audio transmitter, wherein the audio transmitter is disposed in the accommodating portion, an acoustic plane of the audio transmitter is facing toward to the acoustic channel, and a space is between the acoustic plane and the acoustic tube, wherein the magnetic field generator and the magnetic field sensor are electrically connected to the control circuit through a conductive element, and the magnetic field generator and the magnetic field sensor are disposed in the space.

7. The headset apparatus according to claim 1, wherein the headset apparatus is an in-ear type headset apparatus, the headset apparatus further comprises:

an earplug;

a housing, having an accommodating portion and an acoustic tube, the acoustic tube is connected to the earplug to form an acoustic channel; and a circuit board, disposed to the accommodating portion, wherein the control circuit is disposed on the circuit board and electrically connected to the audio transmitter, wherein the audio transmitter is disposed in the accommodating portion, the audio transmitter has an acoustic plane facing toward the acoustic channel and a base opposed to the acoustic channel, wherein the magnetic field generator and the magnetic field sensor are electrically connected to the control circuit through a conductive element, one of the magnetic field generator and the magnetic field sensor is disposed in a space between the acoustic plane and the acoustic tube, and another of the magnetic field generator and the magnetic field sensor is disposed on the base.

8. The headset apparatus according to claim 1, wherein the headset apparatus is an on-ear type headset apparatus, the headset apparatus further comprises:

a head-wearing frame; and a earmuffs component, disposed at both ends of the head-wearing frame, wherein the earmuffs component comprises a housing and a cushioning earpad, wherein the audio transmitter is disposed within the housing, and the magnetic field generator and the magnetic field sensor are disposed within the head-wearing frame or within housing or within the cushioning earpad.

9. The headset apparatus according to claim 1, wherein:

each of the magnetic field generator and the magnetic field sensor comprises a conductive wire or an electrode.

* * * * *